United States Patent [19]

Finan et al.

[11] Patent Number: 4,495,716

[45] Date of Patent: Jan. 29, 1985

[54] APPARATUS FOR HARVESTING PEAT

[75] Inventors: Michael Finan, Ballintubber; Peter Finan, Ballymoe; Michael Divilly, Glenamaddy, all of Ireland

[73] Assignee: Ballintubber Enterprises Limited, Ireland

[21] Appl. No.: 577,914

[22] Filed: Feb. 7, 1984

Related U.S. Application Data

[63] Continuation of Ser. No. 373,567, Apr. 30, 1982, abandoned.

[30] Foreign Application Priority Data

Jun. 10, 1981 [IE] Ireland ..... 1279/81

[51] Int. Cl.[3] ..... E21C 49/00

[52] U.S. Cl. ..... 37/3; 37/191 A; 37/DIG. 17; 44/28; 198/640; 425/202; 425/382 R

[58] Field of Search ..... 37/3, 86, DIG. 17, 191 A; 44/27-31; 198/640, 641; 425/199, 202, 308, 382 R

[56] References Cited

U.S. PATENT DOCUMENTS

| | | | |
|---|---|---|---|
| 362,204 | 5/1887 | Chambers, Jr. | 425/202 |
| 800,367 | 9/1905 | Foster et al. | 198/640 X |
| 858,354 | 6/1907 | Sharpneck | 425/202 X |
| 1,506,036 | 8/1924 | Willmarth | 44/28 |
| 2,817,911 | 12/1957 | Owen et al. | 37/DIG. 17 |
| 2,981,012 | 4/1961 | Meyer | 37/86 |
| 3,398,471 | 8/1968 | Brown | 37/86 |

FOREIGN PATENT DOCUMENTS

| | | | |
|---|---|---|---|
| 81031 | 5/1956 | Denmark | 37/3 |
| 92349 | 12/1961 | Denmark | 37/3 |
| 198990 | 10/1965 | Sweden | 37/3 |
| 606397 | 8/1948 | United Kingdom | 44/30 |
| 764365 | 12/1956 | United Kingdom . | |
| 512294 | 6/1976 | U.S.S.R. | 37/3 |
| 757712 | 8/1980 | U.S.S.R. | 37/3 |
| 751826 | 9/1980 | U.S.S.R. | 44/30 |
| 825968 | 5/1981 | U.S.S.R. | 37/3 |

*Primary Examiner*—Clifford D. Crowder

*Attorney, Agent, or Firm*—Pollock, Vande Sande & Priddy

[57] ABSTRACT

On a known peat harvesting apparatus for mounting on an agricultural tractor comprising (a) a digging chain for insertion into and movement across a bog so as to form a groove, and (b) a peat extrusion press, a roller (107) is mounted above the digging chain (104) to direct harvested peat into the press and prevent the apparatus from clogging. A single drive transmission connects both digging chain (104) and extrusion press (105) to the tractor power take-off shaft. A macerating mechanism is provided in the extrusion press (105) which allows extrusions of relatively small cross section to be produced.

9 Claims, 10 Drawing Figures

APPARATUS FOR HARVESTING PEAT

This is a continuation of application Ser. No. 373,567, filed Apr. 30, 1982, now abandoned.

The present invention relates to peat cutting apparatus, and is particularly concerned with peat cutting apparatus which employs an endless cutting chain.

Examples of peat cutting apparatus employing an endless cutting chain are described in British Patent Specifications Nos. 728,686 (Olle Ollson), 764,365 (Ab Hissfabriken) and Swedish Patent Specification No. 198,990 (Akermans Verkstad Ab).

An object of the present invention is to provide novel peat cutting apparatus which includes a support frame for the apparatus, the support frame comprising a stationary sub-frame, by means of which the apparatus may be connected to or form part of a prime mover, and a movable sub-frame pivotally connected to the stationary sub-frame for swinging movement between two positions, the first position being a transport position and the second position being an operational position, a boom comprising an elongate endless cutting chain, mounted on the movable sub-frame, the movable sub-frame also supporting an extrusion press for collecting peat cut by the cutting chain and delivered to the press, the press containing an auger for extruding the peat from the press, and transmission means operatively connected between the stationary sub-frame and the movable sub-frame for operating the cutting chain and the auger, the transmission means being operable in either position of the movable sub-frame, irrespective of the relative positions of the movable sub-frame.

Further objects and advantages of the present invention will be apparent from the following description of the invention and from the claims.

The invention will now be described in more detail by way of example with reference to the accompanying drawings. In the drawings:

FIG. 1 is a rear view showing the apparatus mounted on an agricultural tractor with the boom shown in the operational position, inserted in the bog;

FIGS. *2a, 2b* and *2c* show front, side and plan views respectively of the apparatus, with the boom shown in the transport position;

Figure 1:
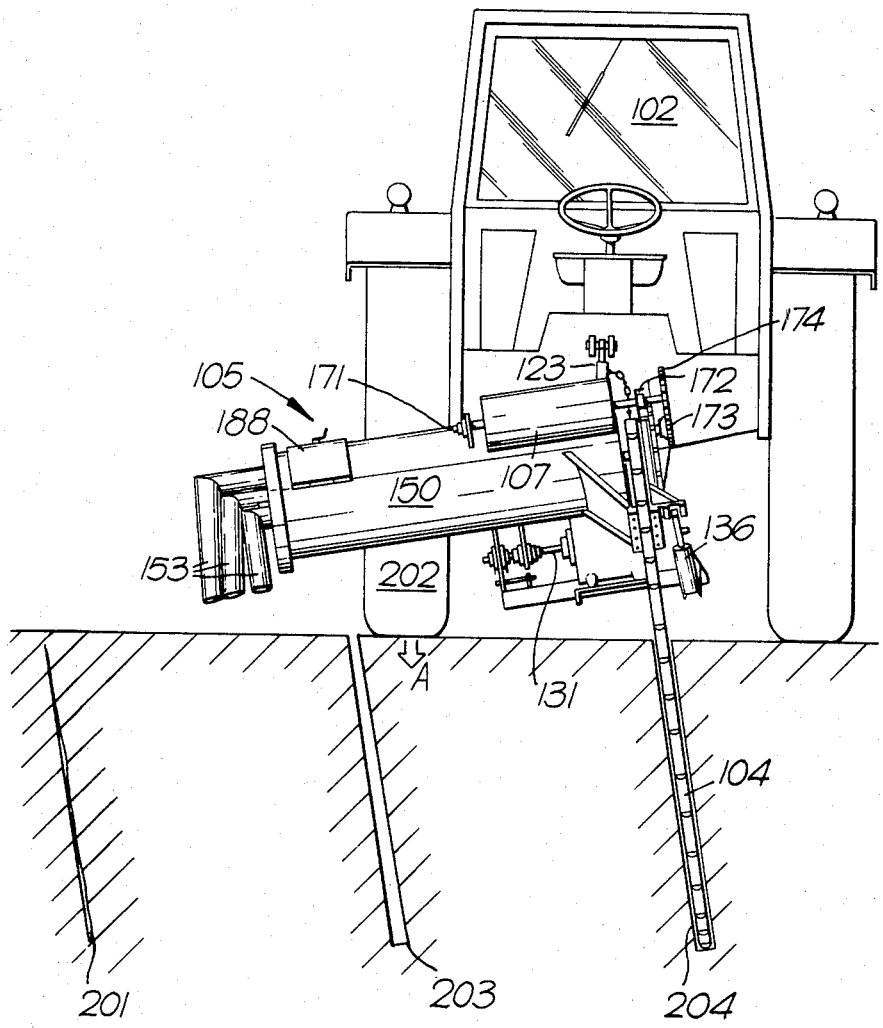

Referring to the drawings, the apparatus comprises generally;

(1): a support frame consisting of (a) a stationary subframe generally designated by the numeral 101 and by means of which the support frame may be mounted upon an agricultural tractor 102 and (b) a movable subframe generally designated by the numeral 103 and pivotally mounted upon the stationary subframe 101;

(2): a digging chain 104 mounted upon the movable subframe 103;

(3): an extrusion press generally designated by the numeral 105 and extending from the movable subframe 103;

(4): a canopy 106 (omitted from all the Figures, except FIG. 5) and roller 107 for delivering cut peat from the digging chain 104 to the extrusion press 105;

(5): a macerating mechanism within the extrusion press 105, consisting of a rotating knife 108;

(6) a drive transmission for driving the digging chain 104, extrusion press 105, roller 107 and macerating mechanism from the tractor power take off shaft; and (7) a slicing mechanism, for slicing the continuous extrusions into sods.

The stationary subframe 101 (see particularly FIG. 3) includes brackets 120, 121, 122 by means of which the stationary subframe 101 may be connected to the three point linkage of tractor 102. The upper linkage 123 (see FIG. 1) of the tractor 102 is connected to bracket 120 and the lower linkages i.e. the draught arms (not shown) of the tractor 102 are connected to brackets 121, 122. Brackets 121 has located towards its lower end mounting apertures 121*a* whereas bracket 122 has located towards its upper end mounting apertures 122*a*. Thus, when mounted upon the three point linkage of the tractor 102, the support frame is disposed at an angle to the horizontal, so that the digging chain 104 is disposed at an angle to the vertical plane through the line of travel of the tractor 102, enabling angled grooves to be made, as shown in FIG. 1.

Figure 3:
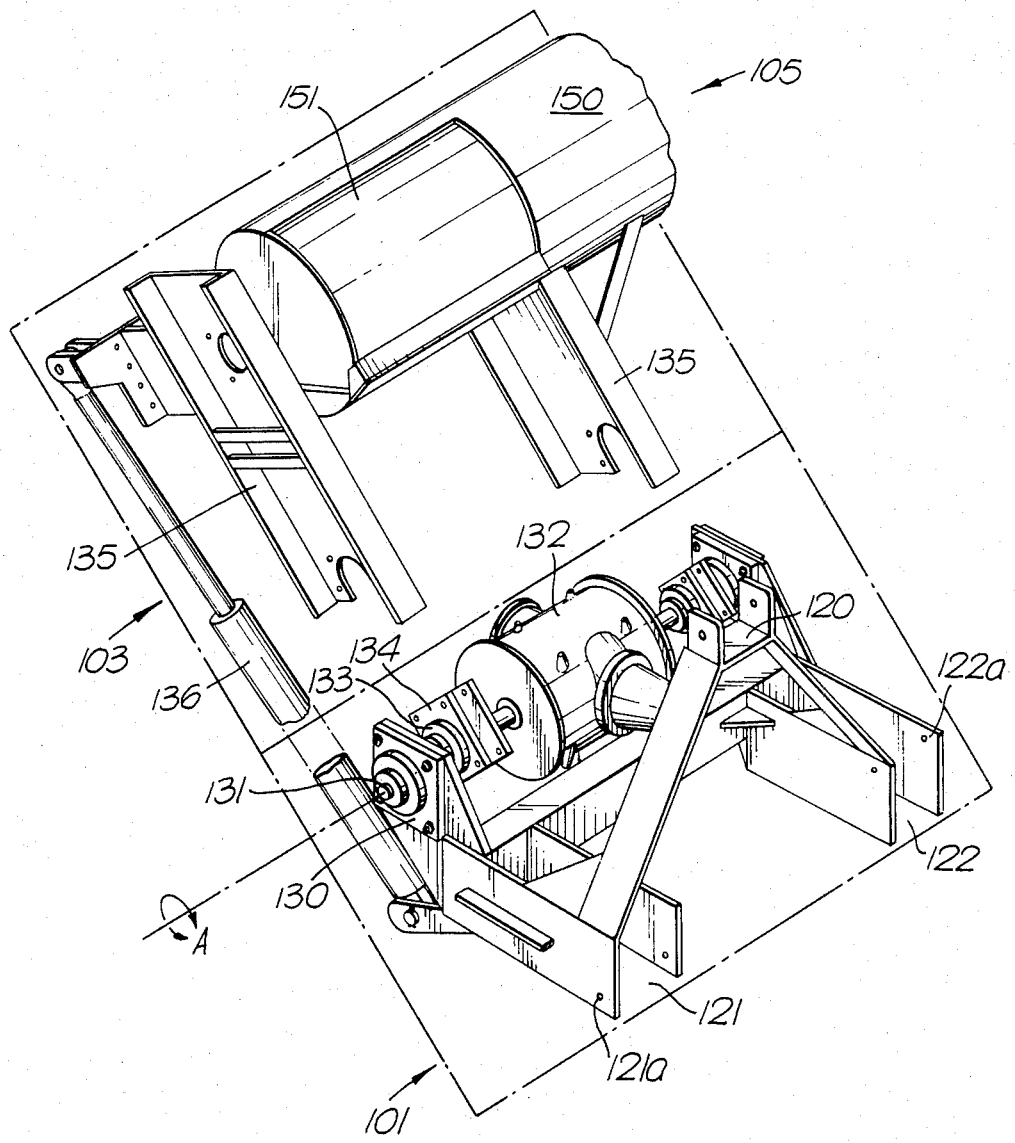
FIG. 3 is a perspective view of part of the apparatus, illustrating the stationary and movable support subframes.

The stationary subframe 101 includes bearing supports 130 for a transverse drive shaft 131 which is driven, via a T-gear mechanism located in gear box 132, from the tractor power take off shaft 137 (see FIG. *2b*). Supported on bearings 133 on the transverse drive shaft 131 is a pair of brackets 134 for receiving and supporting a pair of arms 135 integral with and forming part of the movable subframe 103, and by means of which the movable subframe 103 is pivotable relative to the stationary subframe 101 about the axis defined by transverse drive shaft 131. The pivotal movement, shown by arrow A in FIG. 3, is accomplished by hydraulic ram 136, connected to the tractor hydraulic system so as to be operable from the tractor cabin. It is not necessary to use the tractor hydraulic lift at any stage. The ram 136 is provided with a pressure relief valve (not shown) to enable the digging chain 104 to deflect automatically from the operational position if it encounters an obstacle.

The movable subframe 103 supports both the digging chain 104 and the extrusion press 105. The extrusion press 105 extends laterally from one side of the stationary subframe 101, and the digging chain 104 extends rearwardly from the movable subframe 103, so that, when the movable subframe 103 is pivotally moved relative to the stationary subframe 101, the free end of the digging chain 104 is lowered arcuately toward the bog and, when operating, cuts into the bog to adopt a position in which the digging chain 104 is located at an angle to the vertical plane through the line of travel of the tractor. The angle to the vertical plane transverse to the line of travel of the tractor may be varied by varying the amount by which the movable subframe 103 is pivoted relative to the stationary subframe 101, by means of hydraulic ram 136.

The digging chain 104 (best seen in FIG. 2*b*) comprises an elongated endless toothed chain, mounted on a chain guide 140 and sprockets 141, 142. The chain guide is formed from a chain guide section 140*a* and a member 140*b* of the movable subframe 103. Section 140*a* and member 140*b* are bolted together by bolts 143. The sprockets comprise a drive sprocket 141 and an idler sprocket 142. The digging chain 104 has cutting teeth 145 in the form of circular discs on the links, disposed at an angle of about 45° to the length of the digging chain 104. The digging chain 104 may be tensioned by means of adjusting screw 146, accessible through aperture 147, in the chain guide section 140*a*. Chain guide section 140*a*, which penetrates the bog, may be detached and replaced, when it becomes worn, by slackening digging chain 104 and then removing bolts 143.

Figure 2A:
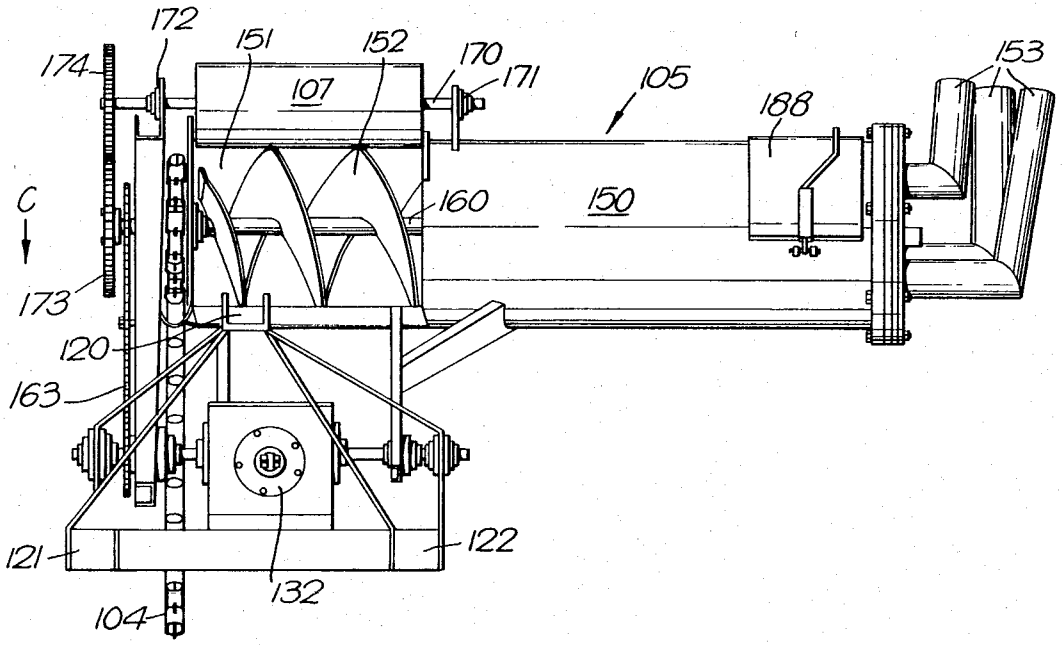

The extrusion press 105 (best seen in FIGS. 2*a* and 2*c*) comprises a transversely mounted cylindrical housing 150. An entry aperture 151 is provided at the end of the housing 150 adjacent the digging chain 104, through which entry aperture 151, the clods 8 of peat enter the housing 150. An auger mechanism 152 in the housing 150 drives the peat towards the other end of the housing 150, where it is extruded through three exit pipes 153 of relatively small cross sectional area.

Figure 4:
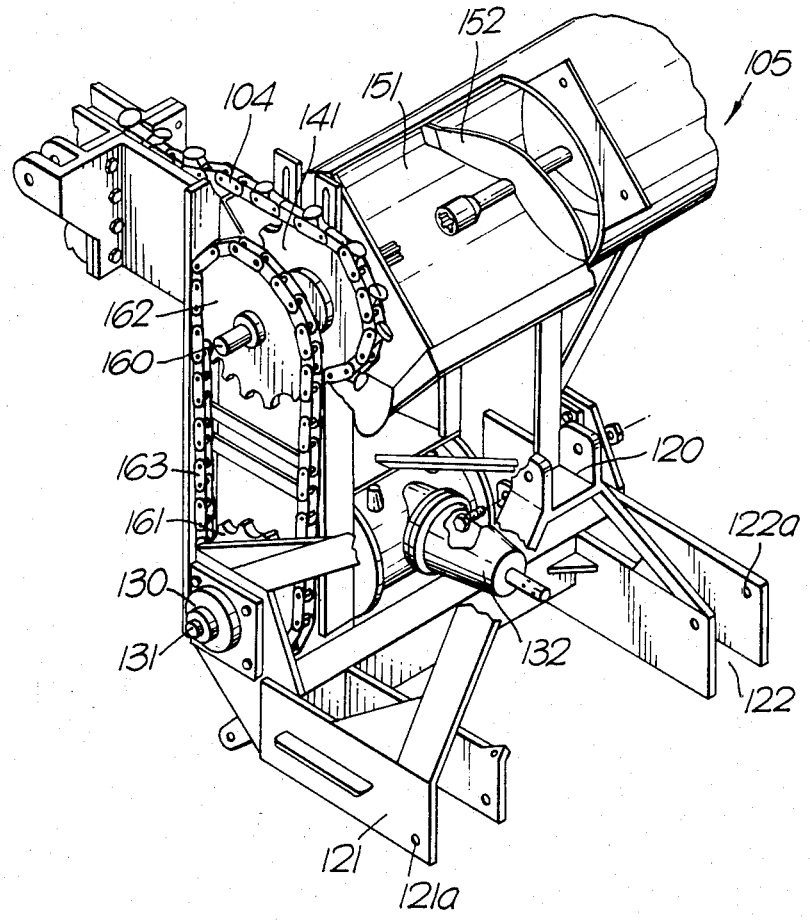
FIG. 4 is a perspective view of part of the apparatus illustrating the drive transmission.

The drive transmission will now be explained in more detail, with particular reference to FIG. 4. The drive from the transverse drive shaft 131 is transmitted to the auger drive shaft 160 via sprockets 161, 162 on shafts 131, 160 respectively, and connecting drive chain 163. The digging chain drive sprocket 141 and the auger mechanism 152 are both fixedly mounted on the auger drive shaft 131 and rotate when the auger drive shaft 131 is driven. The auger drive shaft 160 also drives the roller 107 and the rotating knife 108, as will be explained in more detail below.

Figure 2B:
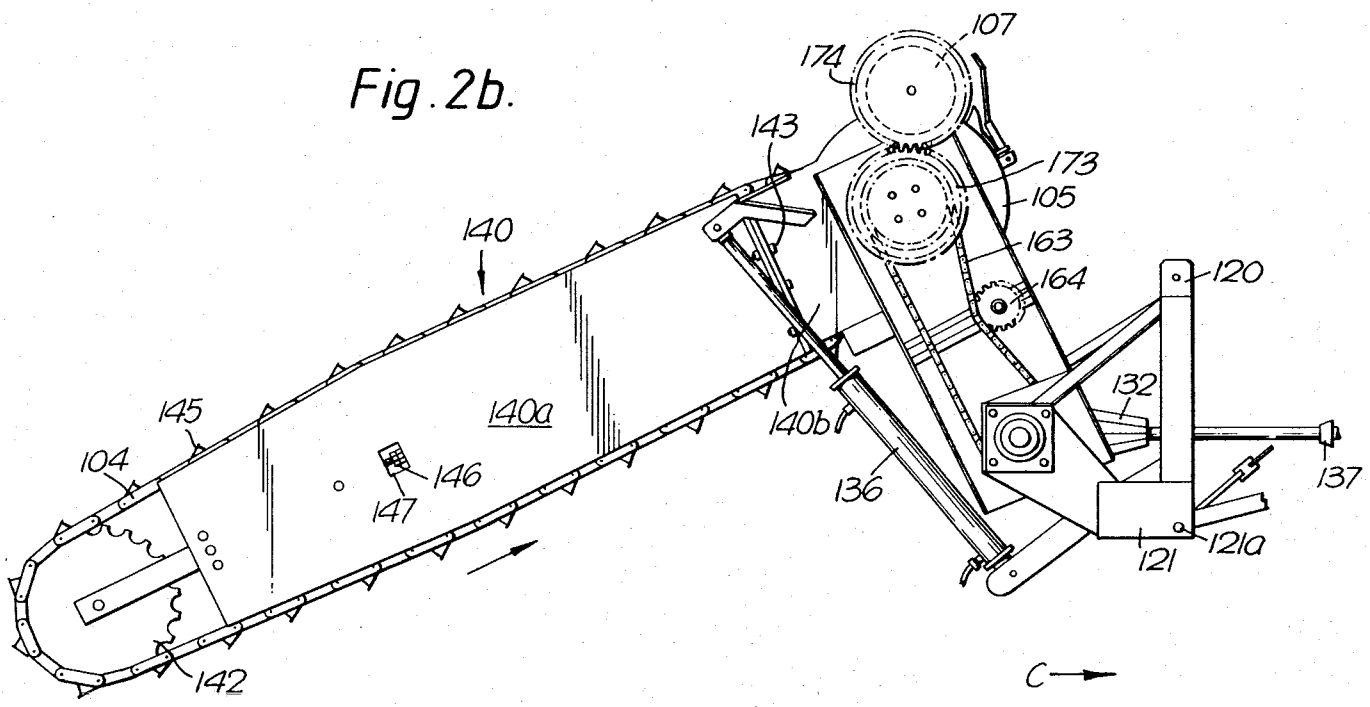
Figure 2C:
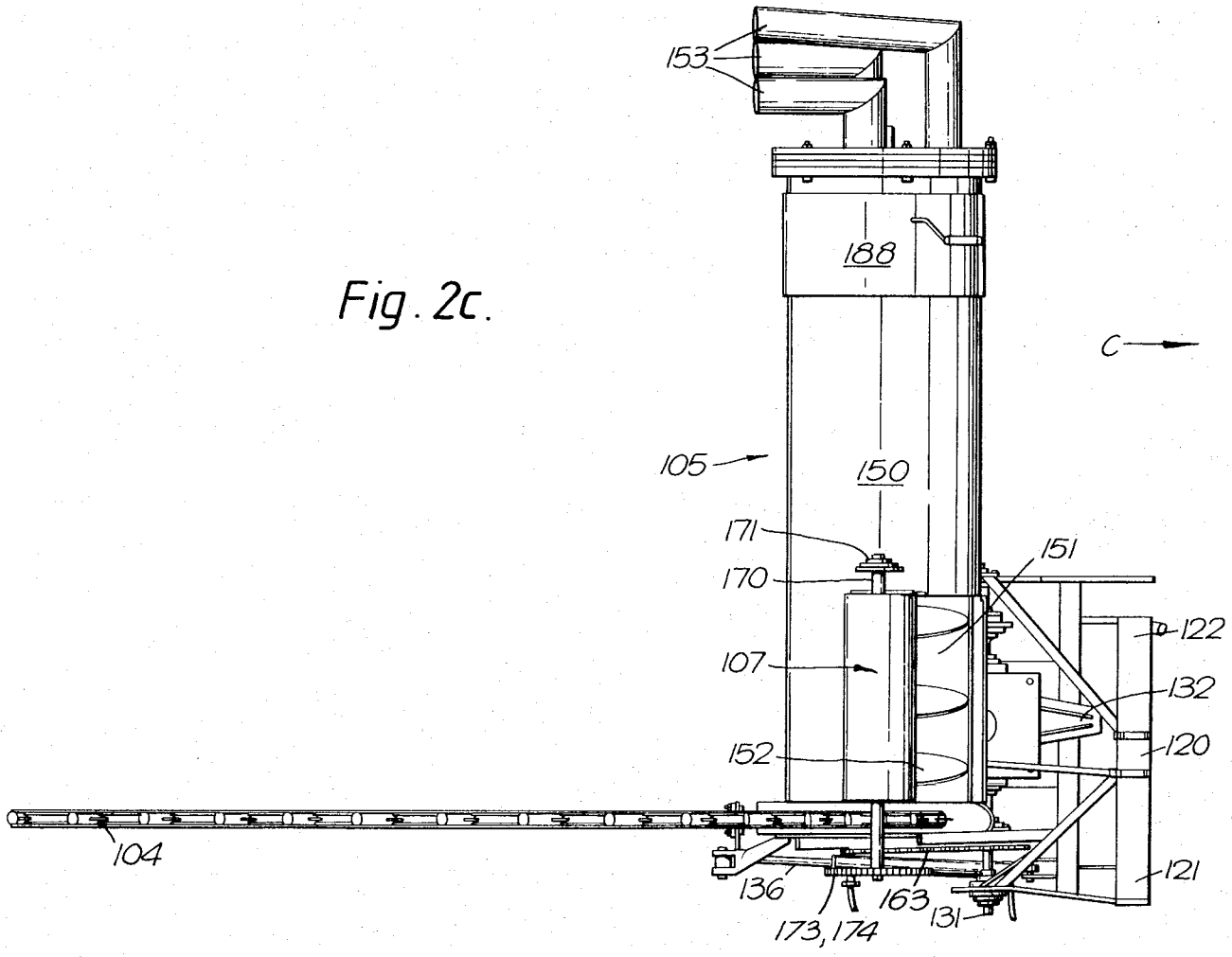

The tension of drive chain 163 may be adjusted by varying the position of tensioning sprocket 164 (see FIG. 2*b*). The auger drive shaft 160 is in two parts, connected by a spline joint 165 (see FIG. 6) which serves to absorb vibration of auger drive shaft 160, thereby lengthening its working life.

Figure 5:
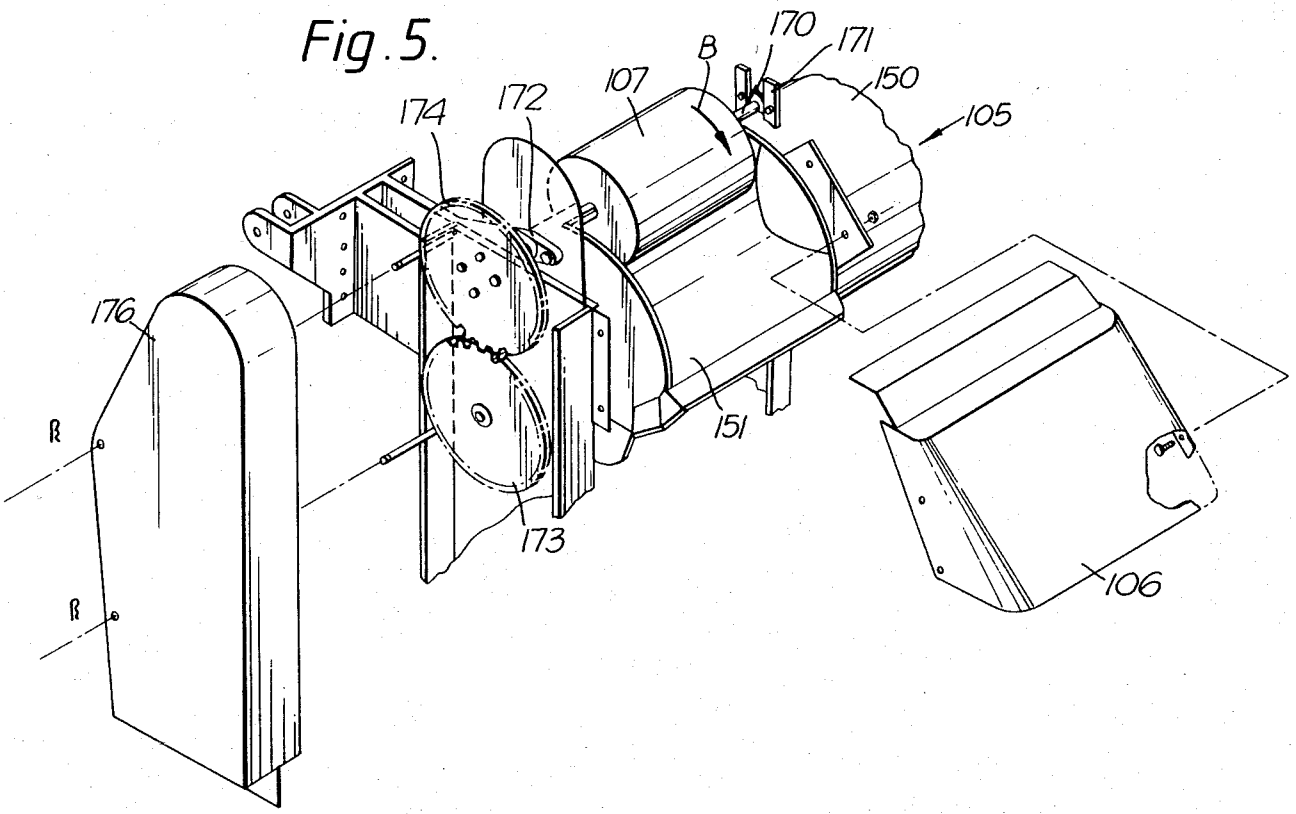
FIG. 5 is an exploded perspective view of part of the apparatus, illustrating the arrangement for bringing cut peat to the extrusion press housing, the arrangement comprising a roller which defines a moving surface, and a canopy.

The peat delivery arrangement will now be described with particular reference to FIGS. 1 and 5. As mentioned, the clods of peat hurled into the air enter an aperture 151 in housing 150. A roller 107 mounted above the aperture 151, on the trajectory of the cut peat, rolls in the direction shown by the arrow B, so as to direct into the aperture 151 any clods which do not enter aperture 151 directly. Because the roller 107 presents a moving surface, the clods do not stick. The roller 107 is mounted on roller shaft 170 which is journalled (see FIG. 5) in brackets 171, 172 on the housing 130, and the movable subframe 103, respectively. The roller 107 is driven from the auger drive shaft 160 by a secondary drive transmission comprising a cog wheel 173 on the auger drive shaft 160, and a meshing driven cogwheel 174 on the roller shaft 170. A housing 176 (shown only in FIG. 5) is provided for the secondary drive transmission. A canopy 106 (shown only in FIG. 5) covers the roller 107, the entry aperture 151 and the top of the digging chain 104. The provision of the roller 107 coupled with the angle of the digging chain 104 in the bog provides an efficient delivery arrangement, as may be appreciated by referring to FIG. 1. The angle of the digging chain gives the clods of cut peat a sideways component towards the aperture 151 and roller 107. The sideways component is maintained when the cut peat falls upon the roller 107.

A macerating mechanism is provided in the extrusion press 105. It is desirable that the extrusions be of relatively small cross-section to facilitate drying. As previously mentioned, because of the subsequent closing over of the groove formed in the bog, production is enhanced. The apparatus of the invention is therefore provided with three extrusion apertures, the three apertures allowing a reduced cross section while at the same time enhancing production. The macerating mechanism is provided to prevent the relatively smaller extrusion apertures from clogging.

Figure 6:
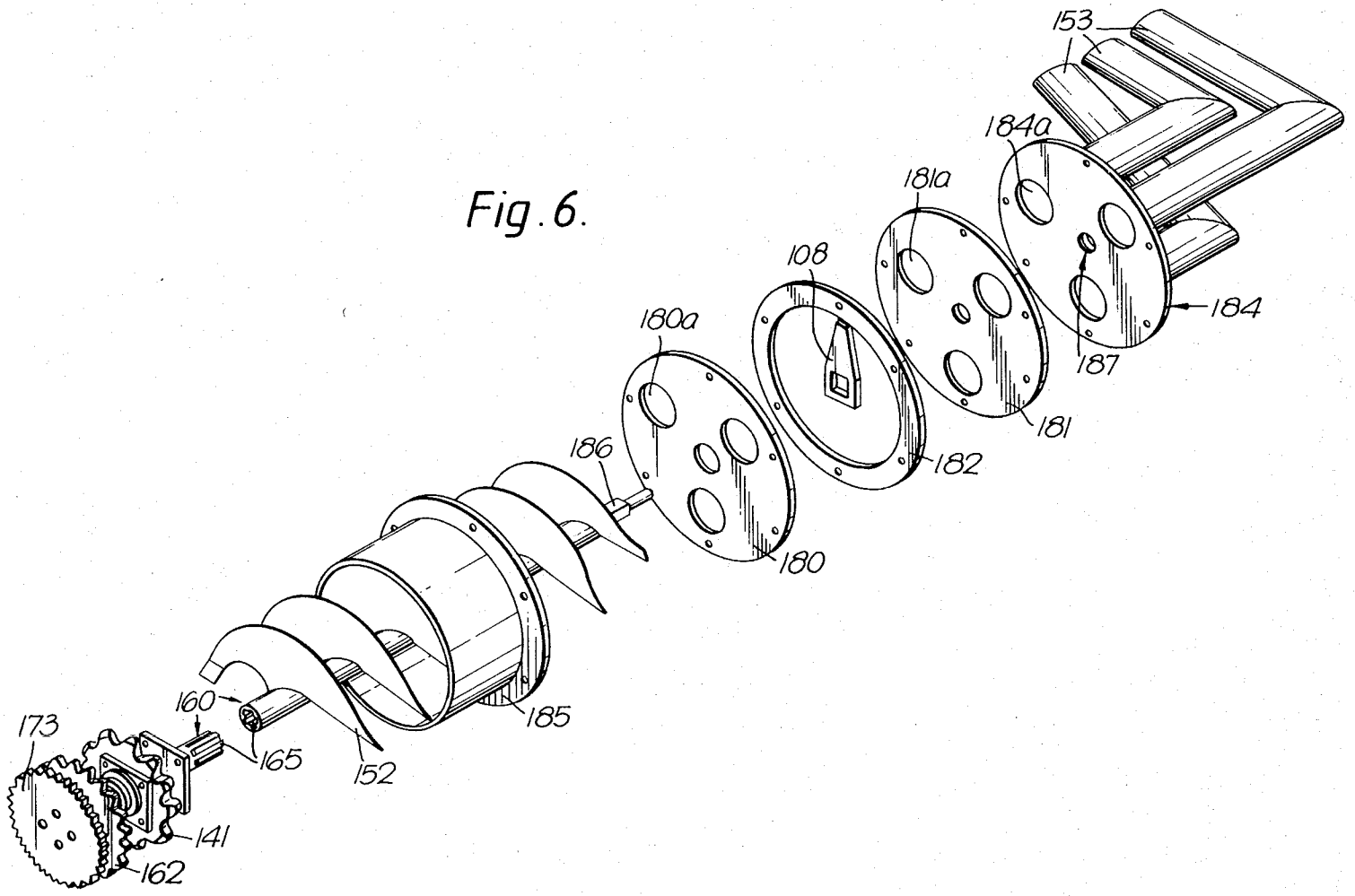
FIG. 6 is an exploded perspective view of part of the apparatus, illustrating the extrusion press and the rotating knife, for macerating the peat.

The macerating mechanism will now be described with particular reference to FIG. 6. The macerating mechanism comprises a first shear plate 180, a second shear plate 181, a spacer 182 between the shear plates and a rotating macerating knife 108, all mounted towards the end of the auger drive shaft 160 so as to rotate therewith, the rotating macerating knife 108 being located in the space between the two shear plates 180 and 181. Peat reaching the end of the housing 150 passes through the three large circular apertures 180*a* in shear plate 180 and on through the corresponding apertures 181*a* in shear plate 181. When passing through the space between the shear plates the peat is cut by the rotating macerating knife 108. The cut peat passes through corresponding apertures 184*a* in end plate 184 and passes through extrusion pipes 153 to fall on the ground in the form of three parallel lines of peat. Shear plates 180, 181, spacer 182 and end plate 184 are bolted to flange 185 on the end of the housing 150. The auger drive shaft 160 is provided with a square end 186 on which the macerating knife 108 is located, and is journalled on a brass bushing 187 in the end plate 184. Should clogging occur in spite of the macerating mechanism, access may be had to the interior of the housing via hatch 188 (see FIGS. 1, 2*a* and 2*c*). As will be appreciated, the drive transmission of the invention, which drives the digging chain 104 and the auger mechanism 152, also drives the macerating knife 108.

Figure 7:
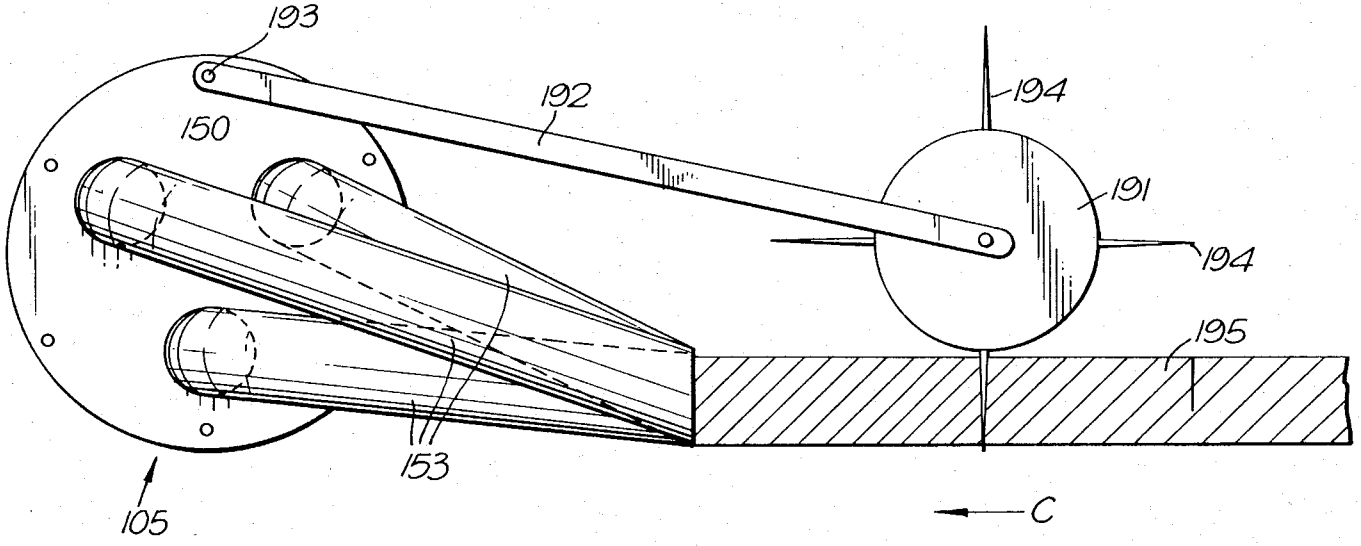
FIGS. 7 and *7a* are side and plan views respectively of a slicing mechanism, for slicing the continuous extrusions into sods.
Figure 7A:
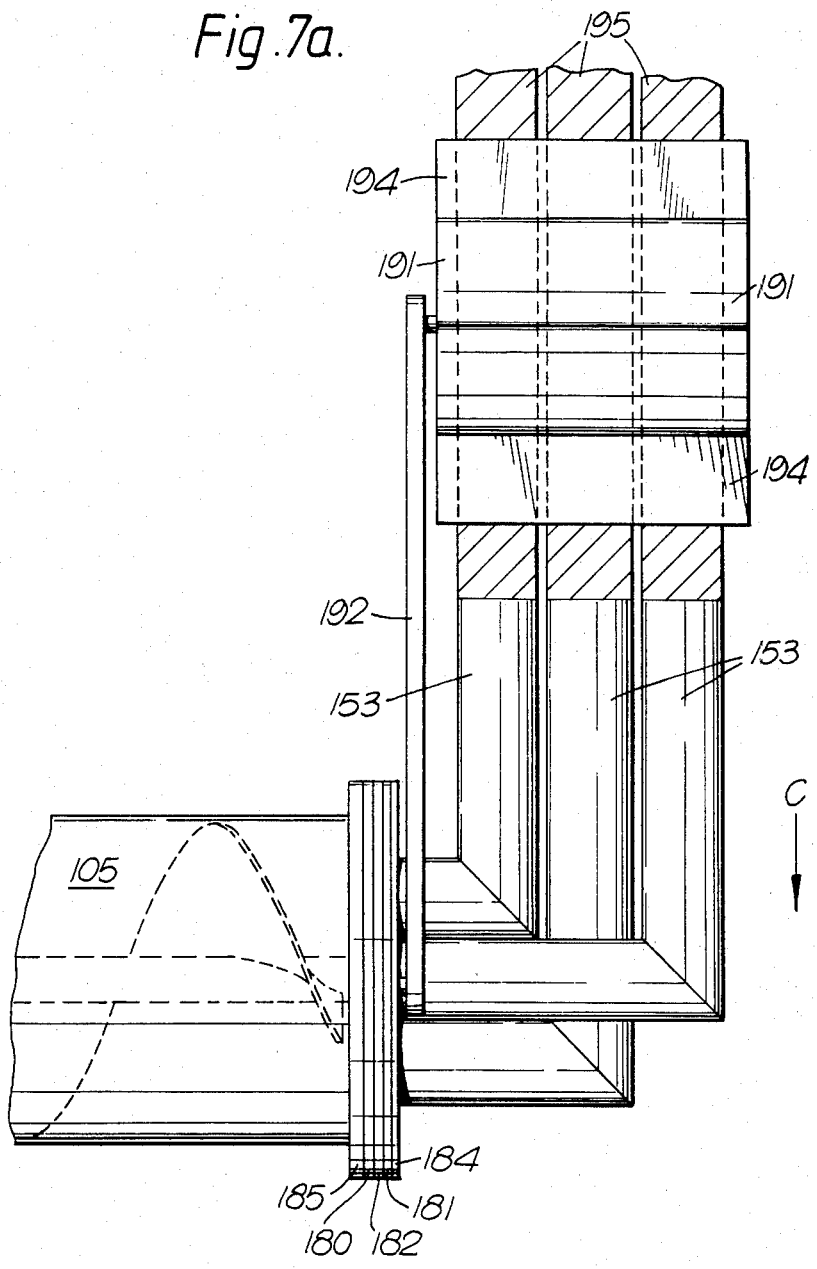

The extruded peat falls on the ground in the form of three parallel lines of peat. These lines are then sliced into sods by a slicing mechanism. The slicing mechanism will now be described with particular reference to FIGS. 7 and 7*a* which show, respectively, a side elevation view of the slicing mechanism, as seen looking towards the end of housing 150, and a plan view of the sliding mechanism. Arrow C indicates the direction of motion of the tractor 102.

This slicing mechanism comprises a hollow drum 191 pivotally connected by arms 192 to a pivot pin 193 extending from the end of the housing 150. The drum 191 is provided with four blades 194 in the form of cleats. The drum 191 is freely rotatable about its longitudinal axis; the emerging lines 195 of peat push the downwardly hanging blade which they encounter ahead of them, causing the drum 191 to revolve and the second blade to swing around behind the first blade, thereby slicing each of the three rows. Thus, three parallel lines of sods lie on the ground behind the tractor 1.

The apparatus produces cylindrical sods which have been found to dry more quickly than conventional rectangular sods.

The length of the sods is determined by, inter alia, the separation of the blades 194 of the slicing mechanism. This separation may be arranged to give any desired length of sod and this feature may be used with advantage to produce sods of somewhat shorter than conventional length which do not have to be broken in two before being inserted in certain stoves, solid fuel burners, and the like.

In the case of larger bogs, apparatus according to the invention, similar to that described above could be made having two or more parallel spaced apart digging chains. For example, a first digging chain could be disposed as shown in the drawings i.e. to one side of the housing, and a second digging chain could project into the housing, as proposed in British Patent Specification No. 764,365 (Ab Hissfabriken). Each digging chain would be driven from the auger drive shaft and a roller would be disposed above each digging chain.

The method of harvesting peat will be apparent from the foregoing description of the apparatus. Referring particularly to FIG. 1, a first groove 201 is made initially. The tractor 1 is then positioned with its left hand rear wheel 202 just above and in line with groove 201. As the tractor 1 moves across the bog, groove 201 is closed as new groove 203 is formed. Subsequently, groove 203 is closed as groove 204 is formed. FIG. 1 shows groove 201 already closed, groove 203 being closed, and groove 204 being formed.

We claim:

1. Peat cutting apparatus comprising:

(a) a support frame;

(b) a boom connected to the support frame and movable between a transport position and an operational position, the boom comprising an elongate endless cutting chain for cutting peat and delivering the cut peat to a position above the boom;

(c) peat deflecting means above the boom and in the path of the delivered peat and defining a moving surface for deflecting the delivered peat;

(d) an extrusion press mounted to one side of the boom, the extrusion press comprising a housing having (i) a collection aperture in the roof of the housing and in the path of the deflected peat, (ii) an exit aperture, and (iii) an auger rotatable in the housing for delivering the collected peat to the exit aperture and for extruding the delivered peat through the exit aperture; and (e) drive means for operating the cutting chain, the auger and the moving surface;

the support frame being connectable to a prime mover for conveying the apparatus over a bog, for operating the drive means and for swinging the boom between its operational and transport positions.

2. Peat cutting apparatus as claimed in claim 1, wherein the peat deflecting means is a roller mounted on an axis parallel to the axis of the chain drive sprocket and auger, the roller being operatively connected to the chain drive sprocket.

3. Peat cutting apparatus according to claim 1 or 2, wherein the support frame is supportable on the prime mover with the axis of the chain drive sprocket and auger at an angle to the horizontal, thereby enabling the boom to enter a bog at an angle to the vertical plane through the line of travel of the prime mover and thereby to form a narrow inclined groove in the bog.

4. Peat cutting apparatus according to claim 1, wherein the chain drive sprocket and the auger are mounted on a common shaft.

5. Peat cutting apparatus as claimed in claim 4, wherein the drive means includes a gear mechanism mounted on the support frame for operative connection to the prime mover and to the common shaft.

6. Peat cutting apparatus according to claim 4 or 5, wherein the common shaft comprises two parts splined together.

7. Peat cutting apparatus as claimed in claim 4, including a drive cogwheel mounted on the common shaft so as to rotate therewith, and a driven cogwheel mounted coaxially with and operatively connected to the roller, the drive and driven cogwheels meshing with one another for operation of the roller during operation of the cutting chain.

8. Peat cutting apparatus as claimed in claim 1, wherein the exit aperture comprises a plurality of extrusion nozzles, and at least one plate is included in the housing adjacent the extrusion nozzles, the plate being fixed within the housing and having apertures providing access to the extrusion nozzles, and a rotatable blade for macerating peat in the vicinity of the apertures to prevent clogging of the nozzles.

9. Peat cutting apparatus according to claim 1, including means on the support frame for connecting the support frame to the three point linkage of an agricultural tractor.

* * * * *